US005576809A

United States Patent [19]

Yazawa et al.

[11] Patent Number: 5,576,809

[45] Date of Patent: Nov. 19, 1996

[54] CHARGE SCREENING MEMBER FOR A CORONA DISCHARGE DEVICE OF AN IMAGE FORMING APPARATUS

[75] Inventors: Hiroaki Yazawa; Shougo Sato; Shinji Ito; Tomoaki Hattori, all of Nagoya, Japan

[73] Assignee: Brother Kogyo Kabushiki Kaisha, Nagoya, Japan

[21] Appl. No.: 500,624

[22] Filed: Jul. 11, 1995

[30] Foreign Application Priority Data

Jul. 26, 1994 [JP] Japan ..... 6-174329
Aug. 31, 1994 [JP] Japan ..... 6-206487

[51] Int. Cl.[6] ..... G03G 15/02

[52] U.S. Cl. ..... 355/225; 355/221

[58] Field of Search ..... 355/221, 224, 355/225

[56] References Cited

U.S. PATENT DOCUMENTS

| | | | |
|---|---|---|---|
| 4,053,769 | 10/1977 | Nishikawa et al. | 355/221 X |
| 4,326,794 | 4/1982 | Nishimura | 355/221 X |
| 4,785,324 | 11/1988 | Yamazaki et al. | 355/297 |
| 4,974,021 | 11/1990 | Takemoto | 355/219 |
| 5,250,992 | 10/1993 | Tsuneeda et al. | 355/221 |
| 5,291,247 | 3/1994 | DeCecca | 355/221 X |

FOREIGN PATENT DOCUMENTS 3-63675 3/1991 Japan .

4-81781 3/1992 Japan .

*Primary Examiner*—Nestor R. Ramirez
*Attorney, Agent, or Firm*—Oliff & Berridge

[57] ABSTRACT

An image forming apparatus comprises a rotatable image carrying member, a charger, a scanner unit for forming a latent image at an exposure position on the surface of the image carrying member charged by the charger, a developing device for converting the latent image to a toner image, and a transfer roller for transferring the toner image on the image carrying member to a recording paper by application of a transfer voltage to the toner image. A conductive member is provided on a charger case covering the charger adjacent to the charger and between the charger and the exposure position. The conductive member is positioned close to the surface of the photosensitive drum. Thus, ions (positive charges) generated by the charger are prevented from reaching the exposure position where the latent image is formed. As a result, negative effects on the image quality of the toner image caused by ions generated by the charger inadvertently recharging discharged portions of the surface of the image carrying member can be averted. Additionally, the image forming apparatus comprises a pre-charging device for emitting light to fully discharge the image carrying member before it is charged by the charger. A blocking wall extends circumferentially along the image carrying member from a partition wall positioned between the charger and the pre-charging device. The blocking wall prevents light emitted by the pre-charging device from reaching the charger, thus preventing the pre-charger from inadvertently discharging the image carrying member.

17 Claims, 6 Drawing Sheets

CHARGE SCREENING MEMBER FOR A CORONA DISCHARGE DEVICE OF AN IMAGE FORMING APPARATUS

BACKGROUND OF THE INVENTION

1. Field of the Invention

This invention is generally related to an image forming apparatus, such as a printer, a copying machine and a facsimile apparatus. More specifically, this invention is directed to a device which prevents ions emitted by a corona discharge device from recharging exposed portions of the photosensitive drum of the image forming apparatus.

2. Description of the Related Art

Conventionally, a so-called scorotron-type charging device using a corona discharge is used as a charging device for an electrophotographic image forming apparatus. The structure of such a scorotron-type charging device 101 is schematically shown in FIG. 8. The charging device 101 is a scorotron having a corona wire 103, which is formed of a fine tungsten wire or the like. The corona wire 103 is stretched to be parallel to an axis of a cylindrical photosensitive drum 102. A grid electrode 104 for controlling the charge is positioned at a predetermined distance from the surface of the photosensitive drum 102. By applying a high voltage, typically several thousand volts, to the charging device 101, ions (positive charges) due to corona discharge are emitted from the corona wire 103 to the photosensitive drum 102. The surface of the photosensitive drum 102 is thus charged by the ions to a positive potential of around 800 V. At this time, the ions are controlled so they uniformly charge the surface of the photosensitive drum 102 by applying a voltage of several hundred volts to the grid electrode 104. The corona wire 103 is surrounded by a charger case 105, which opens toward the photosensitive drum 102.

A laser beam 106, which is modulated corresponding to printing data, is directed against or focussed on the photosensitive drum 102 having been charged as described above. The laser beam 106 discharges only those portions of the photosensitive drum 102 which are irradiated by the laser beam when it is modulated to be in a discharge state (i.e. on). The surface potential of the photosensitive drum 102 at the discharged portions is thus discharged from the original 800 V surface potential to around 100 V. If positively charged toner is then supplied to the photosensitive drum 102, the toner attaches only to the discharged portions of the photosensitive drum 102 where the surface potential is lower than the surrounding charged portions of the photosensitive drum 102, i.e., the portions irradiated by the laser beam 106 when it is on. Thus, a developed electrostatic image is formed on the surface of the photosensitive drum 102. The image is transferred to recording paper by a known transfer device. The transferred image is then fixed to the recording paper by a known fixing device.

However, in the known image forming apparatus as described above, it sometimes occurs that positive charges (ions) produced by the corona device 101 improperly fly to discharged portions where the potential has been lowered after discharging by irradiation of the laser beam 106, thus raising the potential at such recharged portions. In this case, a recharged portion to which the toner should naturally attach to form the developed image instead repels the toner similarly to the charged portions, thus preventing the toner from attaching to the recharged portions of the photosensitive drum 102. Accordingly, while such recharged portions should be used to form developed portions of the image, they instead form blank portions of the image, or fail to have sufficient density, thus severely reducing the quality of the formed image.

To prevent such negative effects, increasing the distance between the position of the charging device 101 and the position where the laser beam 106 is directed against or focussed on the photosensitive drum 102 (i.e. the exposure position where the latent image is formed on the photosensitive drum 102) is considered to be effective when the distance is such the ions produced by the charging device 101 cannot reach the exposure position. However, to accomplish this increase in distance, the image forming apparatus becomes larger and difficulties occur in constructing the apparatus.

SUMMARY OF THE INVENTION

This invention provides an image forming apparatus which prevents the ions generated by the charging device from recharging the discharged portions of the charged photosensitive drum, such that the quality of the image is improved.

Specifically, the image forming apparatus of this invention comprises, in a sequential arrangement about the circumference of a rotatable image carrying member (i.e. the photosensitive drum), charging means for charging the image carrying member, exposure means for directing or focussing a light beam on the image carrying member charged by the charging means at an exposure position to discharge the portions of the image carrying member to form a latent image on the image carrying member, developing means for forming a toner (i.e. developed) image on the image carrying member, transfer means for transferring the toner image from the image carrying member to a recording medium, and a screening member positioned between the charging means and the exposure position, the screen member preventing ions generated by the charging means from reaching the exposure position.

In the image forming apparatus of this invention as described above, a latent image is formed on the image carrying member when the light beam emitted by the exposure means is directed or focussed on on the charged image carrying member at the exposure position. Since a conductive member is provided adjacent to the charging means and between the charging means and the exposure position, ions generated by the charging member are prevented from reaching the exposure position where the latent image is formed.

According to this invention, as described above, since ions generated by the charging means are prevented from reaching the exposure position where the image carrying member is irradiated by the light beam emitted by the exposure means, a high quality image can be formed. Further, since the exposure position and the charging means can be positioned close to each other, the overall size of the image forming apparatus is smaller.

DESCRIPTION OF THE PREFERRED EMBODIMENTS

Figure 1:
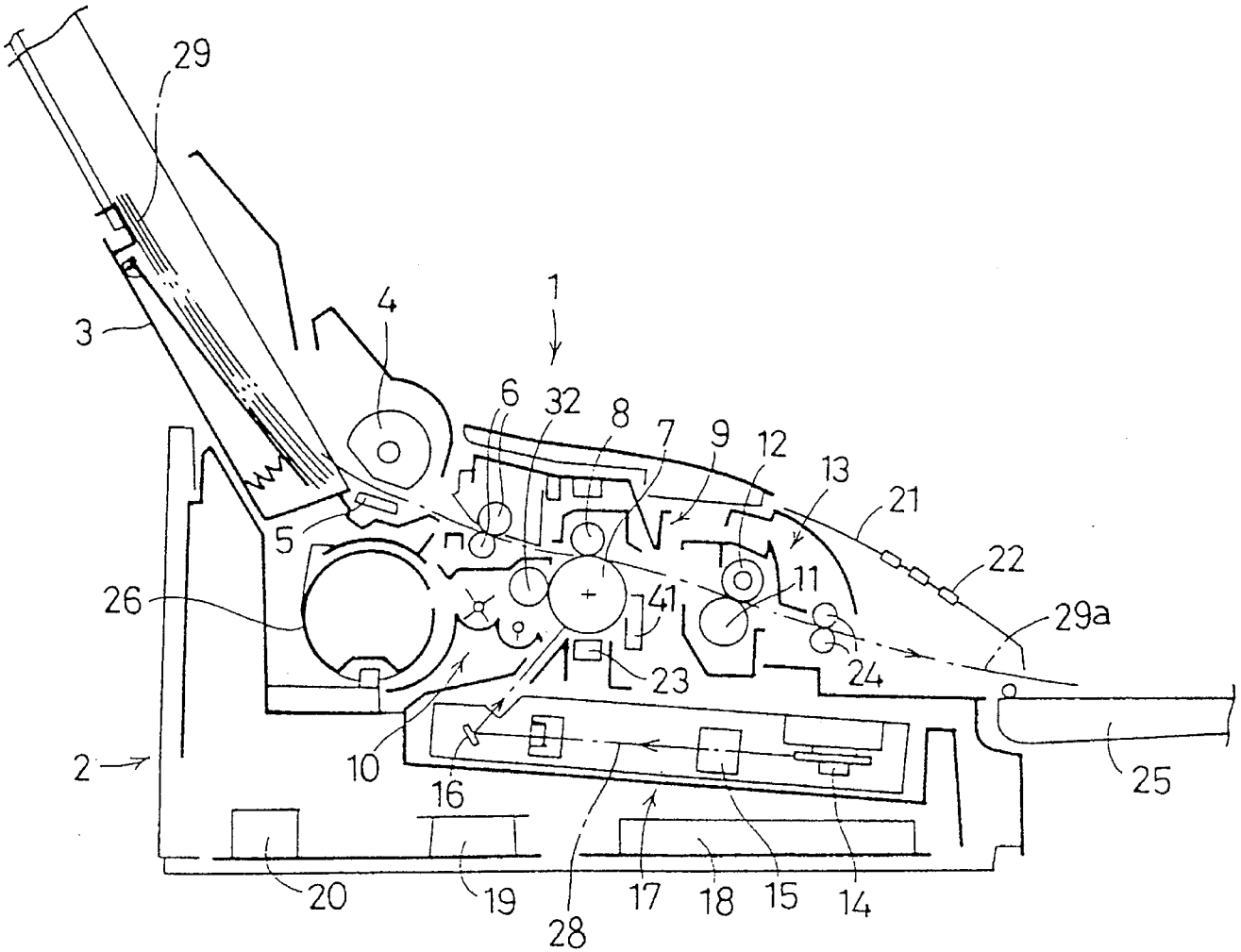
FIG. 1 is a side sectional view of an image forming apparatus.

FIG. 1 is a side sectional view schematically showing a laser beam-type image forming apparatus (i.e. a laser printer) 1. As shown in FIG. 1, the laser printer 1 has a paper supply cassette 3 which is removably mounted at the top of one side of a body case 2 of the laser printer 1. One sheet at a time is separated from the sheets of paper 29 by a paper feed roller 4 and a separating pad 5. The sheets of paper 29 are used as the recording medium and are piled up in the paper supply cassette 3. The separated sheet of paper **29*a* is fed through a pair of feed rollers 6 to a photosensitive unit 9 having a photosensitive drum 7 as the image carrying member, a transfer roller 8 as the transfer means, and the like. A developing device 10 is positioned adjacent to the photosensitive unit 9 on the side toward the paper supply cassette 3. A fixing unit 13, having a heat roller 11 and a press roller 12 is positioned adjacent to the photosensitive unit 9** on its opposite side.

A scanner unit 17 having a laser beam emitting device 14 which emits a laser beam 28, a lens 15, a reflecting mirror 16, and others, control boards 18 and 19, a power supply unit 20, and the like, is positioned below the photosensitive unit 9. A keyboard 22 having a plurality of control buttons is positioned on a cover member 21 of the body case 2 of the laser printer 1.

The laser beam 28 is directed by the mirror 16 so that it irradiates the surface of the photosensitive drum 7 at an exposure position 54. As the laser beam 28 is emitted, it is modulated between a non-discharging, or "OFF", state and a discharging, or "ON", state based on image data input to the laser printer 1 from an external source, such as a computer, a scanner or the like. Based on the ON or OFF state of the laser beam 28, the previously charged surface of the photosensitive drum 7 is selectively discharged to form an electrostatic latent image on the surface of the photosensitive drum 7. Then, to develop the latent image into a developed, or toner, image, magnetized toner powder is supplied to the latent image by rotating a developing sleeve 32 in the developing device 10. Next, the toner image is transferred to the sheet of paper **29*a* inserted between the photosensitive drum 7 and the transfer roller 8. Heat and pressure are then applied to the sheet of paper 29*a* and the transferred image in the fixing unit 13 to fix the toner image onto the sheet of paper 29*a*. Thereafter, the sheet of paper 29*a* is discharged through a pair of discharge rollers 24 into a discharge tray 25 of the printer 1**.

Figure 2:
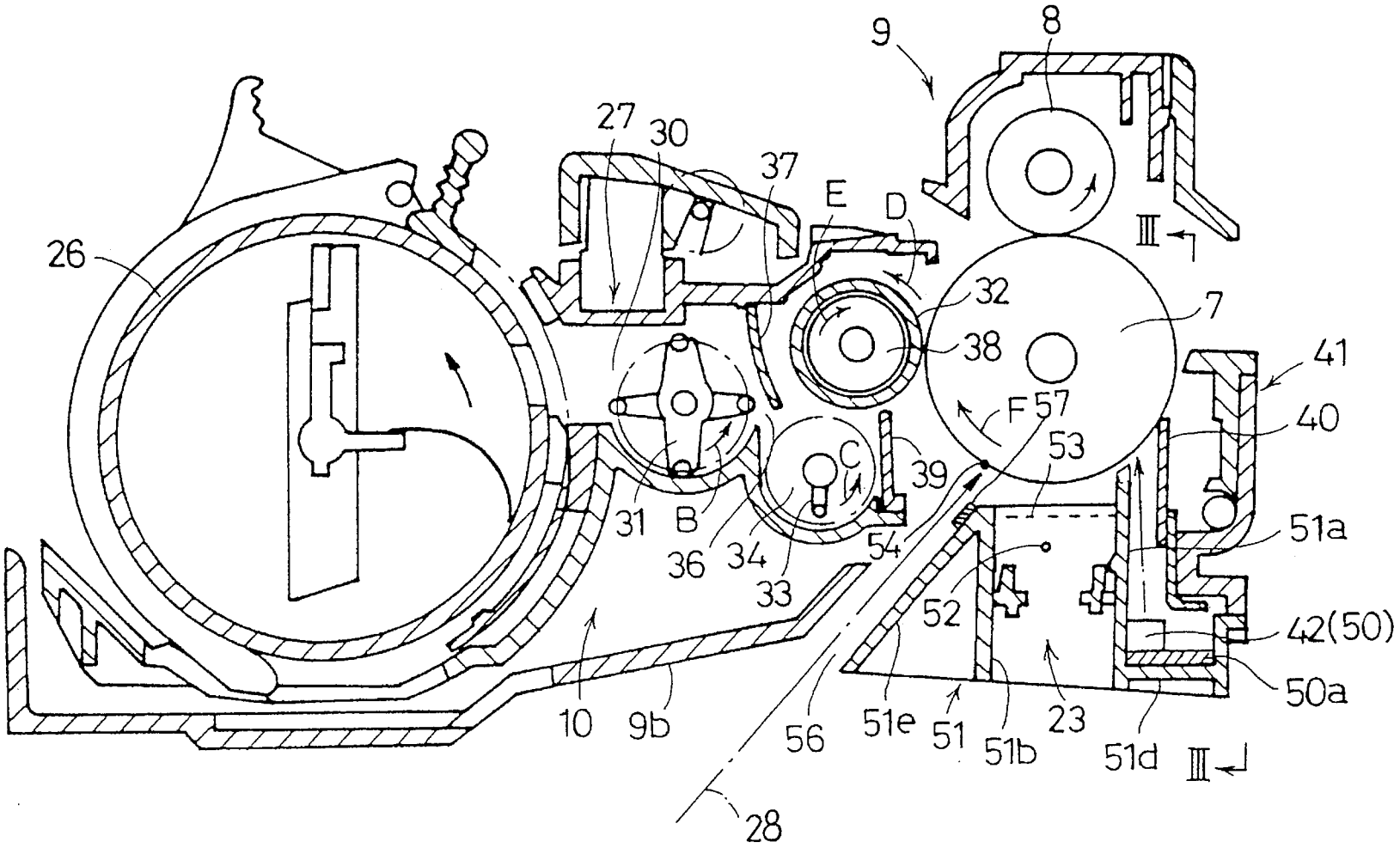
FIG. 2 is a side sectional view of an image forming unit of a first preferred embodiment of the invention.

FIG. 2 is a side sectional view showing in greater detail the developing device 10 and the photosensitive unit 9. A case 27, made of plastic or the like, of the developing device 10 is divided into an agitating chamber 30 and a developing chamber 34 by a partition wall, as shown in FIG. 2. An opening 36 in the partition wall is formed facing on one side of the circumferential surface of the developing sleeve 32.

A toner box 26 forms a toner supplying chamber for supplying nonmagnetic or magnetic toner to the agitating chamber 30, and is removably mounted on a pair of right and left bracket portions (not shown) which project from one side of the case 27. The supplied toner is agitated by an agitating member 31 formed of rotating vanes within the agitating chamber 30.

The developing sleeve 32 is positioned within the developing chamber 34, and incorporates a magnet roller 38. A second agitating member 33, which is formed of a rotating vane or the like, is positioned below the developing sleeve 32. One side of the circumferential surface of the rotatable developing sleeve 32 is positioned to contact the surface of the photosensitive drum 7.

A regulating member 37 is positioned in the vicinity of the opening 36, such that a middle portion of the regulating member 37 extends down into the developing chamber 34 to oppose the circumferential surface of the developing sleeve 32. The free end of the regulating member 37 is positioned close to but outside of the rotational space of the second agitating member 33.

The first agitating member 31 rotates in the direction shown by arrow B, as shown in FIG. 2, and scoops up the toner from a bottom of the agitating chamber 30 and raises the toner to the opening 36. The second agitating member 33 rotates in the direction indicated by arrow C and agitates the toner supplied through the opening 36 and the magnetic carrier previously contained in the developing chamber 34. The second agitating member 33 passes the toner over the bottom of the developing chamber 34 and then lifts up the toner to the bottom surface of the developing sleeve 32. The developing sleeve 32 rotates in the direction indicated by arrow D. The magnet roller 38, which has its north poles N and its south poles S alternately arranged about its circumference, rotates within an inner portion of the developing sleeve 32 in the opposite direction as indicated by arrow E. The developing sleeve 32 is positioned close to the photosensitive drum 7, which rotates in the direction indicated by arrow F.

A trimmer blade 39 is positioned close to one side of the circumferential surface of the photosensitive drum 7 and within the developing chamber 34. The trimmer blade 39 adjusts the thickness of the layer of the toner carried by the magnetic carrier on the circumferential surface of the developing sleeve 32.

The developing system used in this first preferred embodiment may be the so-called 2-component developing system in which the magnetic carrier accounts for 95–98% by weight and the nonmagnetic toner accounts for 2–5% by weight, the so-called 1.5-component system in which the magnetic carrier accounts for 30–80% by weight and the magnetic toner accounts for 20–70% by weight, or the 1-component developing system in which the nonmagnetic toner accounts for 100%.

The transfer roller 8 is positioned at the top side of the circumferential surface of the photosensitive drum 7 and is preferably a conductive sponge roller. A portion of the recording paper **29*a* which is pressed by the transfer roller 8 against the surface of the photosensitive drum 7 is the transfer portion. The toner on the surface of the photosensitive drum 7, which is not transferred to the transfer portion of the recording paper P, is swept out by a cleaner 41 having a cleaning blade 40 slidably contacting the surface of the photosensitive drum 7 at the other side of the photosensitive drum 7. A light emitting element, which is preferably a light emitting diode (LED) 50**, is positioned between the cleaner 41 and the charger 23, and forms a pre-exposure means 42 of this invention.

The charger 23 of this first preferred embodiment is a scorotron having a corona wire 52 and a grid electrode 53. The corona wire 52 is preferably a fine tungsten wire. The grid electrode 53 controls the charges transferred from the corona wire 52 to the surface of the photosensitive drum 7. When a high voltage of several hundred volts is applied to the charger 23, it generates ions by a corona discharge emitted from the corona wire 52. The ions positively charge the surface of the photosensitive drum 7. At this time, a voltage of several hundred volts is applied to the grid electrode 53 to control the charging.

A plurality of light emitting elements 50, which form the pre-exposure means 42, are positioned on the outside of a charger case 51 of the charger 23. The plurality of light emitting elements 50 are arranged along the rotational axis of the photosensitive drum 7, as shown in FIG. 3.

The charger 23 and the light emitting elements 50 are supported on the case 51, which is made of an opaque and insulating material. The case 51 is formed as a box extending along the length of the photosensitive drum 7 parallel to its rotational axis. The case 51 has a partition wall 51*a* separating the charger 23 from the light emitting elements 50. The end of the partition wall 51*a* extends toward the surface of the photosensitive drum 7.

The case 51 has a frame member integrally made up of a side wall 51*b* spaced apart from one side of, and extending parallel to, the partition wall 51*a*. End walls 51*c* are joined to the side wall 51*b* and the partition wall 51*a* at each ends. Together, the partition wall 51*a*, the side wall 51*b*, and the end walls 51*c* provide a box space opening toward the photosensitive drum 7. The corona wire 52 is stretched in the box space between the end walls 51*c*. The grid electrode 53 is attached to the case 51 to cover the opening of the box space facing the photosensitive drum 7. One end of the partition wall 51*a* extends beyond the grid electrode 53 toward the photosensitive drum 7. The case 51 also has a support wall 51*d* integrally formed with and outwardly projecting from the partition wall 51*a*. A wiring board 50*a* is fixedly positioned on the support wall 51*d*. The light emitting elements 50 are positioned in an array on the wiring board 50*a*. The array of light emitting elements 50 is positioned close to the partition wall 51*a* and aligned parallel to the rotational axis of the photosensitive drum 7 so that the photosensitive drum 7 is exposed to the light emitted by the light emitting elements 50 along its length.

Figure 3:
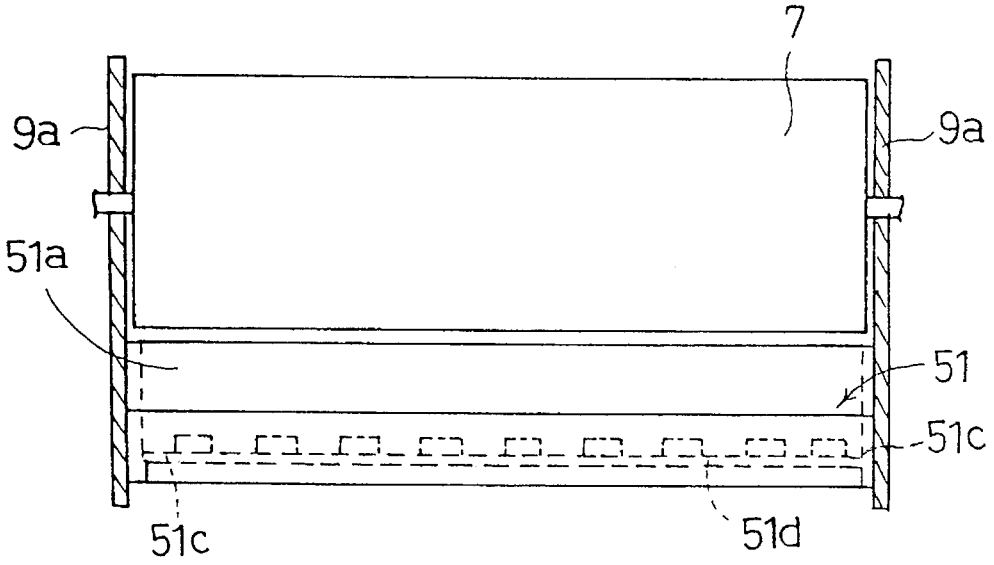
FIG. 3 is a sectional view along the line III—III in FIG. 2.

As shown in FIG. 3, the case 51 is fixed at both its end walls 51*c* to a pair of side walls 9*a* of the photosensitive unit 9. The pair of side walls 9*a* also rotatably support the photosensitive drum 7.

The case 51 further has a wall 51*e* which extends outwardly from the side wall 51*b* at an angle, as shown in FIG. 2. Between the wall 51*e* and a bottom wall 9*b* of the photosensitive unit 9, a path 56 is provided which allows the laser beam 28 emitted from the scanner unit 17 be introduced to and directed or focussed on the surface of the photosensitive drum 7 at the exposure position 54. A conductive member 57 is positioned on the side of the wall 51*e* facing the path 56, and prevents the ions produced from the corona wire 52 of the charger 23 from reaching the exposure position 54, where the surface of the photosensitive drum 7 is irradiated by the laser beam 28. The conductive member 57 is formed of synthetic rubber type paint containing carbon and having a conductivity corresponding to a surface resistance value of at most $10^{14}\Omega$. One end of the conducting member 57 is electrically grounded. Thus, an electric field is formed between the photosensitive drum 7 and the conductive member 57. In particular, the electric field extends from the photosensitive drum 7 to the conductive member 57.

Figure 5:
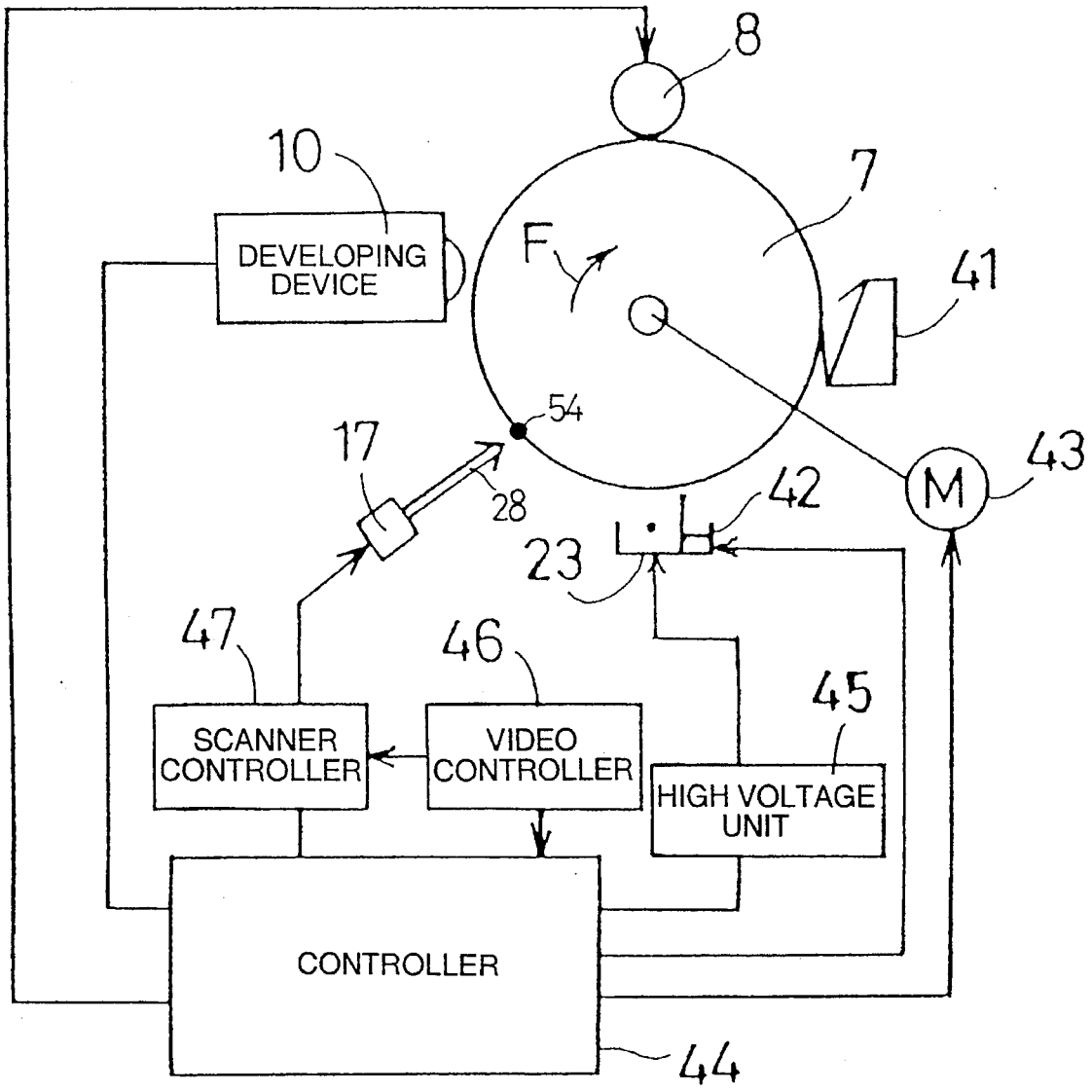
FIG. 5 is a block diagram of a controller for the image forming unit.

As shown in FIG. 5, a control means for controlling the photosensitive unit 9 and the pre-exposure means 42 includes a controller 44, a video controller 46, and a scanner controller 47. The controller 44 controls the operation of a drive motor 43, the charger 23, the pre-exposure means 42, the scanner unit 17, the developing device 10, and the transfer roller 8. A high voltage unit 45 applies a high voltage around 4–7 kV to the charger 23. The video controller 46 and the scanner controller 47 control the scanner unit 17 based on the image data from the external equipment such as a host computer, as described above.

In operation, while the photosensitive drum 7 rotates at a constant number of revolutions in the direction indicated by arrow F, the surface of the photosensitive drum 7 is charged to a potential of around 800 V by the charger 23. Then, the surface potential on the discharged portions of the photosensitive drum 7 generated by the charger 23 is neutralized to a level of around +100 V by the laser beam 28 emitted by the scanner unit 17 when the laser beam 28 is on. The laser beam 28 irradiates the surface of the photosensitive drum 7 at the exposure position 54. At the same time, the non-discharged portions, i.e., the portions not irradiated by the laser beam 28 when the laser beam 28 is off, are kept at the originally-formed +800 V surface potential. The positively charged toner in the developing device 10 is transferred to the discharged portions of the photosensitive drum 7 by an electric field formed between the developing sleeve 32 and the photosensitive drum 7. Then, a transfer voltage of around −1 kV to −4 kV is applied to the toner image by the transfer roller 8 to transfer the toner image to the recording paper 29*a* passing through the pressure position between the transfer roller 8 and the photosensitive drum 7.

In the electrophotographic process described above, the charger 23 charges the surface of the photosensitive drum 7 at the same time the laser beam 28 emitted by the scanner unit 17 discharges the discharge portions of the charged surface of the photosensitive drum 7. Therefore, it sometimes occurs that positive charges generated by the charger 23 reach the discharged portions where the potential has already been lowered by the irradiation of the laser beam 28 and recharge the discharged portions. This prevents the toner from attaching to the recharged portions of the surface of the photosensitive drum 7 at the desired density, if at all. Accordingly, image portions of the image are instead formed as blank portions or the image portions are not sufficiently densely formed.

In the first preferred embodiment, the conductive member 57 prevents the ions produced from the corona wire 52 from reaching the exposure position 54 and thus recharging the discharged portions irradiated by the laser beam 28. The conductive member 57 is placed on the wall 51*e* of the case 51 of the charger 23, and one end of the conductive member 57 is grounded. Thus, an electric field is formed between the surface of the photosensitive drum 7 and the conductive member 57. Therefore, the ions produced from the corona wire 52, except those used to initially charge the photosensitive drum 7, are not allowed to reach the exposure position 54 but are instead trapped into or conducted away by the conductive member 57. Thus, the discharged portions, once the surface potential is lowered, are not recharged to a surface potential between the initial +800 V surface potential and the +100 V discharged surface potential. Therefore, a latent image exactly corresponding to the image data can be formed.

It is not necessary to electrically ground the conductive member 57. Rather, it may be sufficient to set the conductive member 57 to a different and lower potential than the surface potential of the photosensitive drum 7, for example, to a potential of 5 VDC, 24 VDC, and so on.

Since the conductive member 57 is integrally formed with the case 51 which covers the charger 23, the overall apparatus can be made smaller and the fabrication of the apparatus can be facilitated because the charger 23 and the conductive member 57 can be assembled as an integral body into the laser printer 1.

Figure 6:
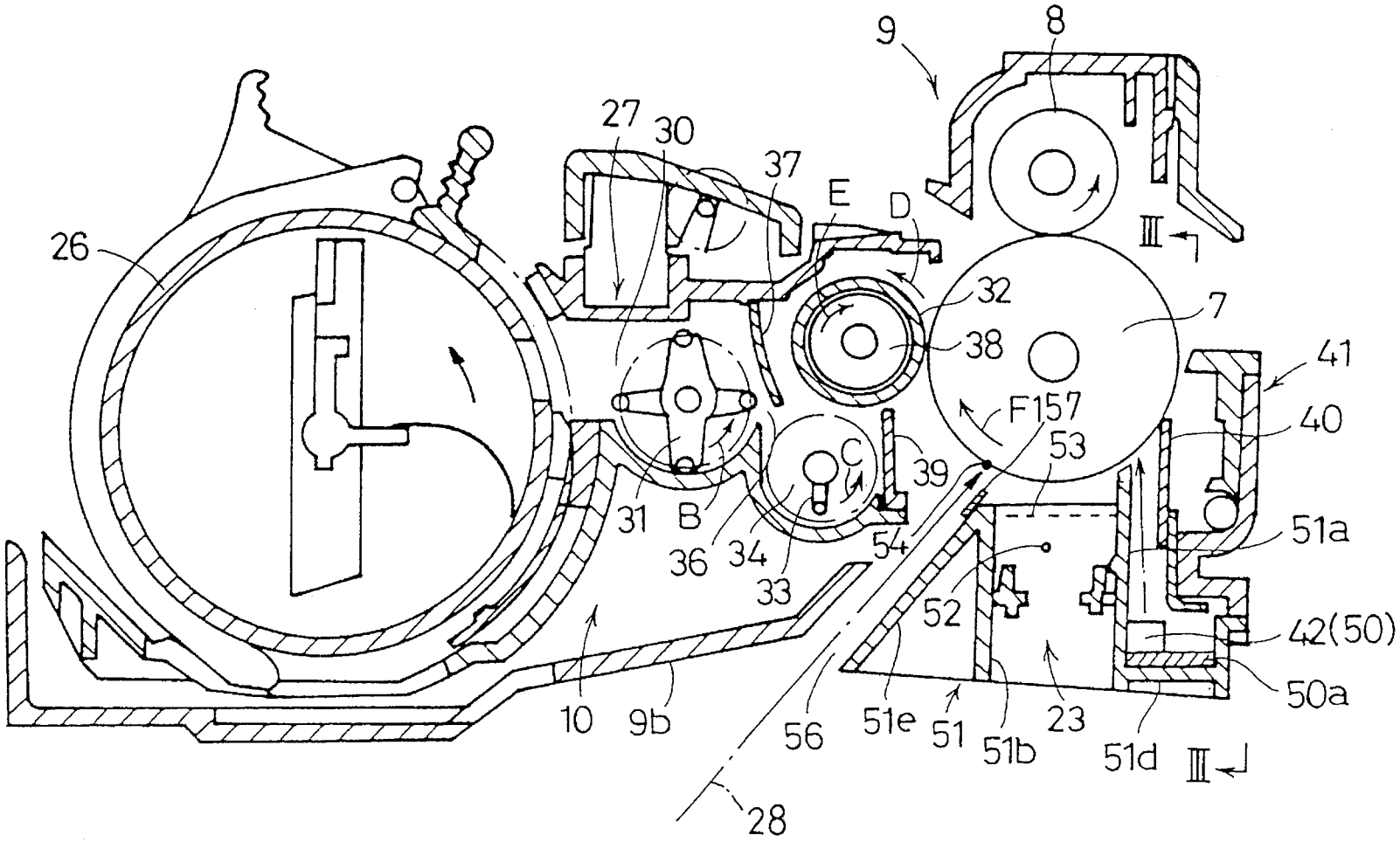
FIG. 6 is a side sectional view of the image forming unit of a second preferred embodiment of the invention.
Figure 7:
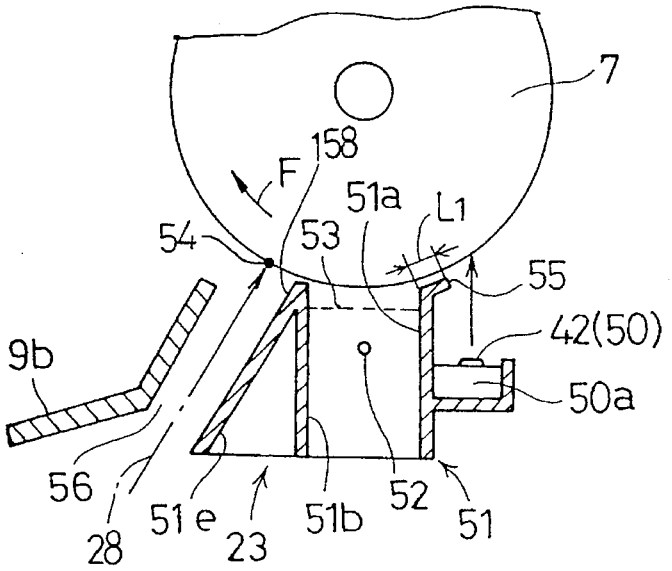
FIG. 7 is a side sectional view of a modification of the second preferred embodiment.
Figure 8:
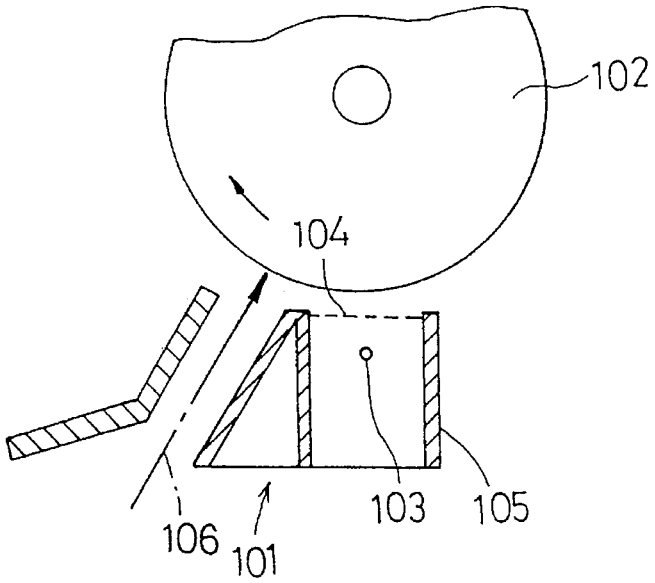
Fig.8 PRIOR ART
FIG. 8 is a sectional view of a prior art image forming apparatus.

A second preferred embodiment, in which the conductive member 57 is replaced with a screening member formed of an insulating film, is shown in FIGS. 6 and 7. Since the structure and functioning of this second preferred embodiment are the same as those in the first preferred embodiment, except those relating to the conductive member 57, only the different elements and operation, as shown in FIG. 6, will be described, with corresponding parts denoted by corresponding reference numerals.

As shown in FIG. 6, a screening member 157 is positioned on the wall 51*e* on the side facing the path 56. The screening member 157 prevents ions produced from the corona wire 52 of the charger 23 from reaching the discharged portions irradiated by the laser beam 28. The screening member 157 is formed of an insulating film of, for example, PET (polyethylene terephthalate). The screening member 157 is supported in such a position that the distance between its end portion and the photosensitive drum 7 is around 1.5 mm. That is, the end portion of the screening member 157 is closer to the photosensitive drum 7 than the grid electrode 53. It is not necessary to form the screening member 157 separately from the case 51. Rather, a portion of the case 51 may be modified such that a screening portion 158 and the wall 51*e* are integrally formed by extending the wall 51*e* of the case 51 toward the photosensitive drum 7, as shown in FIG. 7. This modification also contributes to a decrease in the number of component parts.

Due to the screening member 157, the discharged portion of the surface of the photosensitive drum 7 where the surface potential has once been lowered by irradiation of the laser beam 28 is not recharged by having the surface potential raised back towards the initial +800 V surface potential. Therefore, a latent image exactly corresponding to the image data can be formed. Since the end portion of the screening member 157 projects from the grid electrode 53 toward the surface of the photosensitive drum 7, the space formed between the photosensitive drum 7 and the grid electrode 53 can be made smaller. Hence, the effect of preventing ions produced from the corona wire 52 of the charger 23 from flowing into the portion irradiated by the beam can be greatly enhanced and an image in high quality can be obtained.

In either of the above described first and second embodiments, the initial surface potential of the photosensitive drum 7 remains distributed in a spotted or speckled manner due to the discharged and non-discharged portions formed by irradiation of the beam modulated according to the image data. If the surface of the photosensitive drum 7 is then immediately recharged by the charger 23, the surface cannot be uniformly charged due to the effects caused by the remaining initial surface potential. Therefore, the pre-exposure means 42 is used to completely irradiate the surface of the photosensitive drum 7 to discharge the surface of the photosensitive drum 7 to a surface potential which is below the +100 V discharged surface potential of the discharged portions irradiated by the laser beam 28.

Thus, if the partition wall 51*a* does not extend close to the surface of the photosensitive drum 7, the portion of the surface of the photosensitive drum 7 irradiated by the light from the pre-exposure member 42 extends into the area charged by the charger 23 to impair the charging effect of the charger 23. Therefore, the space formed between the photosensitive drum 7 and the opposing grid electrode 53 at the pre-exposure means side of the case 51 can be made as small as possible by extending the partition wall 51*a* toward the photosensitive drum 7. By bringing the end of the partition wall 51*a* between the charger 23 and the pre-exposure means 42 closer to the surface of the photosensitive drum 7 so that the end of the partition wall 51*a* is spaced only 1.5 mm or so, for example, from the surface of the photosensitive drum 7, the light emitted from the pre-exposure means 42 to the photosensitive drum 7 is prevented from penetrating the case 51 of the charger 23 to extend into the charged area. Therefore, the charging effect in the area charged by the charger 23 is unimpaired.

Figure 4:
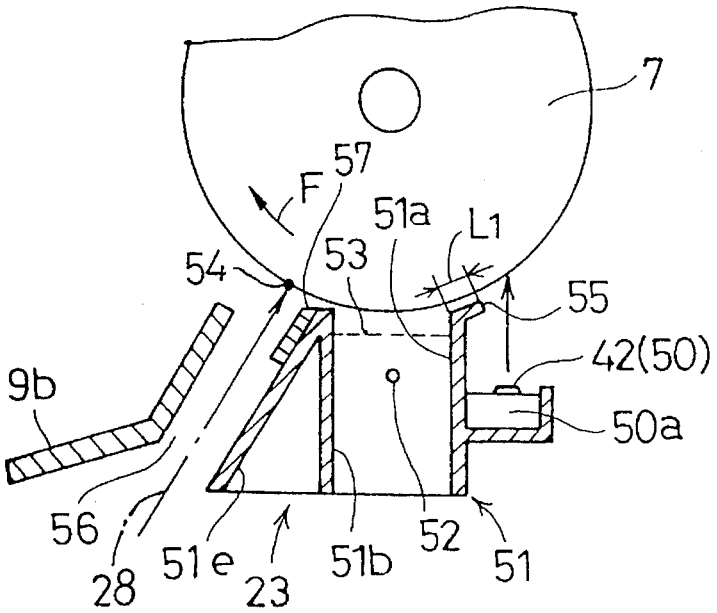
FIG. 4 is a side sectional view of a modification of the first preferred embodiment.

The case 51 of the first and second preferred embodiments may be modified by widening the end portion 55 of the partition wall 51*a*, as shown in FIG. 4 and FIG. 7, to extend a suitable length L1, which is preferably 1 mm or more, along the circumference of the photosensitive drum 7. By widening the end portion 55, the light emitted from the pre-exposure means 42 to the photosensitive drum 7 can be completely prevented from extending into the charged area by the charger 23, whether directly or indirectly. Using a side plate of the charger case 51 to provide the partition wall 51*a* eliminates the necessity for an additional part to form the partition wall and reduces the number of component parts.

It should also be appreciated that, in the case where the surface of the photosensitive drum 7 is negatively charged by the charger 23, due to the combination of the photosensitive layer of the photosensitive drum 7 and the inner conductive layer, and surface of the photosensitive drum 7 is positively charged by the pre-exposure means 42, the same functioning and effects as described above can of course be obtained.

Further, it should be appreciated that any known type of photosensitive image carrying member, not only the photosensitive drum 7, can be used with this invention. Thus, the image forming apparatus may use, for example, a photosensitive belt rather than a photosensitive drum.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus comprising:

an image carrying member;

charging means for charging said image carrying member;

exposure means for directing a light beam on said image carrying member charged by said charging means at an exposure position to form a latent image on the image carrying member;

developing means for converting the latent image on said image carrying member to a toner image;

transfer means for transferring the toner image formed on said image carrying member to a recording medium;

a case extending parallel to a rotational axis of said image carrying member;

a screening means for preventing ions generated by said charging means from reaching the exposure position where the latent image is formed, said screening means positioned on said case adjacent to said charging means and between said charging means and said exposure position; and pre-charging means supported by said case for emitting light to fully discharge said image carrying member prior to charging said image carrying member using said charging means, wherein said case comprises:

a partition wall extending towards said image carrying member between said charging means and said pre-charging means, and a blocking wall formed at an end of said partition wall near said image carrying member and extending from the end of said partition wall along a circumference of said image carrying means, wherein said blocking wall prevents the light emitted by said pre-charging means from extending past said partition wall toward said charging means.

2. The image forming apparatus of claim 1, wherein said charging means comprises:

a corona wire positioned apart from and parallel to said screening member; and a grid electrode positioned between said corona wire and said image carrying member;

wherein said screening means extends closer to said image carrying member than said grid electrode.

3. The image forming apparatus of claim 1, wherein said screening means is a conductive member.

4. The image forming apparatus of claim 3, wherein said conductive member is electrically grounded.

5. The image forming apparatus of claim 1, wherein said screening means is an insulating member.

6. The image forming apparatus of claim 1, further comprising a second wall extending from said partition wall and supporting said pre-charging means.

7. An image forming apparatus comprising:

an image carrying member;

a scorotron capable of charging said image carrying member to an initial surface potential, said scorotron emitting charged particles to said image carrying member;

a light beam emitting device emitting a modulated light beam;

an optical system directing the modulated light beam emitted by the light beam emitting device to an exposure position of said charged image carrying member to form a latent image on the image carrying member;

a developing sleeve transferring toner to the latent image to form a toner image on said image carrying member;

a transfer device transferring the toner image formed on said image carrying member to a recording medium; and a screening member which prevents the charged particles generated by said scorotron from reaching the exposure position where the latent image is formed, said screening member positioned adjacent to said scorotron, between said scorotron and said exposure position, wherein said scorotron comprises:

a case extending parallel to a rotational axis of said image carrying member, said screening member integrally formed with said case;

a corona wire positioned apart from and parallel to said screening member; and a grid electrode positioned between said corona wire and said image carrying member, said screening member extending closer to said image carrying member than said grid electrode; and at least one light emitting device supported by said case, the at least one light emitting device emitting light to fully discharge said image carrying member prior to charging said image carrying member using said scorotron, wherein said case comprises:

a partition wall extending towards said image carrying member between said corona wire and said at least one light emitting device; and a blocking wall formed at an end of said partition wall near said image carrying member and extending from the end of said partition wall along a circumference of said image carrying member, wherein said blocking wall prevents the light emitted by said at least one light emitting device from extending past said partition wall toward said corona wire.

8. The image forming apparatus of claim 7, wherein said screening member is a conductive member.

9. The image forming apparatus of claim 8, wherein said conductive member is electrically grounded.

10. The image forming apparatus of claim 7, wherein said screening member is an insulating member.

11. The image forming apparatus of claim 7, further comprising a second wall extending from said partition wall and supporting said at least one light emitting device.

12. An image forming apparatus comprising:

an image carrying member;

charging means for charging said image carrying member;

exposure means for directing a light beam on said image carrying member charged by said charging means at an exposure position to form a latent image on the image carrying member;

developing means for converting the latent image on said image carrying member to a toner image;

transfer means for transferring the toner image formed on said image carrying member to a recording medium;

a case extending parallel to a rotational axis of said image carrying member; and pre-charging means supported by said case for emitting light to fully discharge said image carrying member prior to charging said image carrying member using said charging means, wherein said case comprises:

a partition wall extending towards said image carrying member between said charging means and said pre-charging means, and a blocking wall formed at an end of said partition wall near said image carrying member and extending from the end of said partition wall along a circumference of said image carrying member, wherein said blocking wall prevents the light emitted by said pre-charging means from extending past said partition wall toward said charging means.

13. The image forming apparatus of claim 12, wherein said charging means comprises:

a corona wire positioned apart from said partition wall; and a grid electrode positioned between said corona wire and said image carrying member;

wherein said partition wall extends closer to said image carrying member than said grid electrode.

14. The image forming apparatus of claim 12, further comprising a screening member which prevents ions generated by said charging means from reaching the exposure position where the latent image is formed, said screening member positioned adjacent to said charging means and between said charging means and said exposure position.

15. The image forming apparatus of claim 14, wherein said screening member is a conductive member.

16. The image forming apparatus of claim 15, wherein said conductive member is electrically grounded.

17. The image forming apparatus of claim 12, further comprising a second wall extending from said partition wall and supporting said pre-charging means.

* * * * *